United States Patent [19]

Nader

[11] Patent Number: 4,524,869

[45] Date of Patent: Jun. 25, 1985

[54] PILL DISPENSER AND METHOD OF LOADING

[76] Inventor: N. Joseph Nader, 1601 Highland Oaks Dr., Arcadia, Calif. 91006

[21] Appl. No.: 572,157

[22] Filed: Jan. 17, 1984

[51] Int. Cl.[3] ..... B65D 3/28; B65D 83/04; B65D 85/56

[52] U.S. Cl. ..... 206/358; 116/308; 206/533; 206/534

[58] Field of Search ..... 206/538, 533, 531, 532, 206/534; 116/308

[56] References Cited

U.S. PATENT DOCUMENTS

| | | | |
|---|---|---|---|
| 3,276,573 | 10/1966 | Kaufman et al. | 206/531 |
| 3,394,796 | 7/1968 | Jensen | 206/533 |
| 3,437,236 | 4/1969 | Huck | 206/534 |
| 3,502,772 | 3/1970 | Ijzerman | 206/531 |
| 3,570,707 | 3/1971 | Finkel | 206/534 |
| 3,651,927 | 3/1972 | Richardson et al. | 206/534 |
| 3,876,269 | 4/1975 | Fisher et al. | 206/534 |
| 3,921,806 | 11/1975 | Wawracz | 206/533 |
| 4,015,717 | 4/1977 | Richardson et al. | 206/534 |
| 4,165,709 | 8/1979 | Studer | 206/534 |

*Primary Examiner*—William T. Dixson, Jr.
*Assistant Examiner*—Brenda J. Ehrhardt
*Attorney, Agent, or Firm*—Lyon & Lyon

[57] ABSTRACT

A pill dispenser employing a cartridge contained within and rotatably mounted to a housing. The housing includes a cover and a base. The base has a post extending to receive the cartridge and a dispensing hole therethrough. The cover includes a boss having an asymmetry which allows for alignment of the cartridge when positioned on the cover. The cartridge includes holes at first radially equal locations from the center of the cartridge with one blank space therein and a second row of holes inwardly thereof. Thus, multiple pills may be dispensed through the dispensing hole in the base on a multiple cycle basis.

10 Claims, 6 Drawing Figures

PILL DISPENSER AND METHOD OF LOADING

BACKGROUND OF THE INVENTION

The field of the present invention is pill dispensers of the type employed for cyclical dispensing and methods of loading same. For hormone cotrol on a monthly cycle or other like purposes, individuals are required to take one or more pills on a daily basis for a period of time. The pills may then be discontinued for an additional period. During that cycle, subcycles may exist where additional pills must be taken. One such routine involves taking conjugated estrogens in the form of a pill for 25 days augmented by a progesterone in the form of a pill for the last 10 of the 25 days. For three days, neither pill is taken.

Needless to say, the foregoing routines are sufficiently complicated to often require some means for keeping track of the schedule. One mechanism for doing so has been the pill dispensing system. Such systems have included a housing having a rotatable cartridge containing pills in cavities thereof. As the user rotates the cartridge, pills may be dispensed through an opening in the housing. However, such devices do not contemplate the dispensing of pills based on multiple cycles. Additionally, such devices necessarily do not allow any flexibility with regard to pill mix. Furthermore, the devices are not readily employed by the user for filling.

SUMMARY OF THE INVENTION

The present invention pertains to a pill dispenser and a method for loading a pill dispenser. The pill dispenser makes provision for multiple cycles. Additionally, the dispenser allows facile loading of pills in prearranged cavities which are then appropriately aligned and locked in place for use during the cycle. This is particularly advantageous for foolproof loading by the user.

The method of loading pills in a pill dispenser contemplates the alignment of a cartridge for dispensing, the facile loading of pills and the aligned locking of the pills into the housing for proper dispensing.

Accordingly, it is a principal object of the present invention to provide an improved pill dispenser. It is another object of the present invention to provide a method for loading a pill dispenser. Other and further objects and advantages will appear hereinafter.

DETAILED DESCRIPTION OF THE PREFERRED EMBODIMENT

Figure 1:
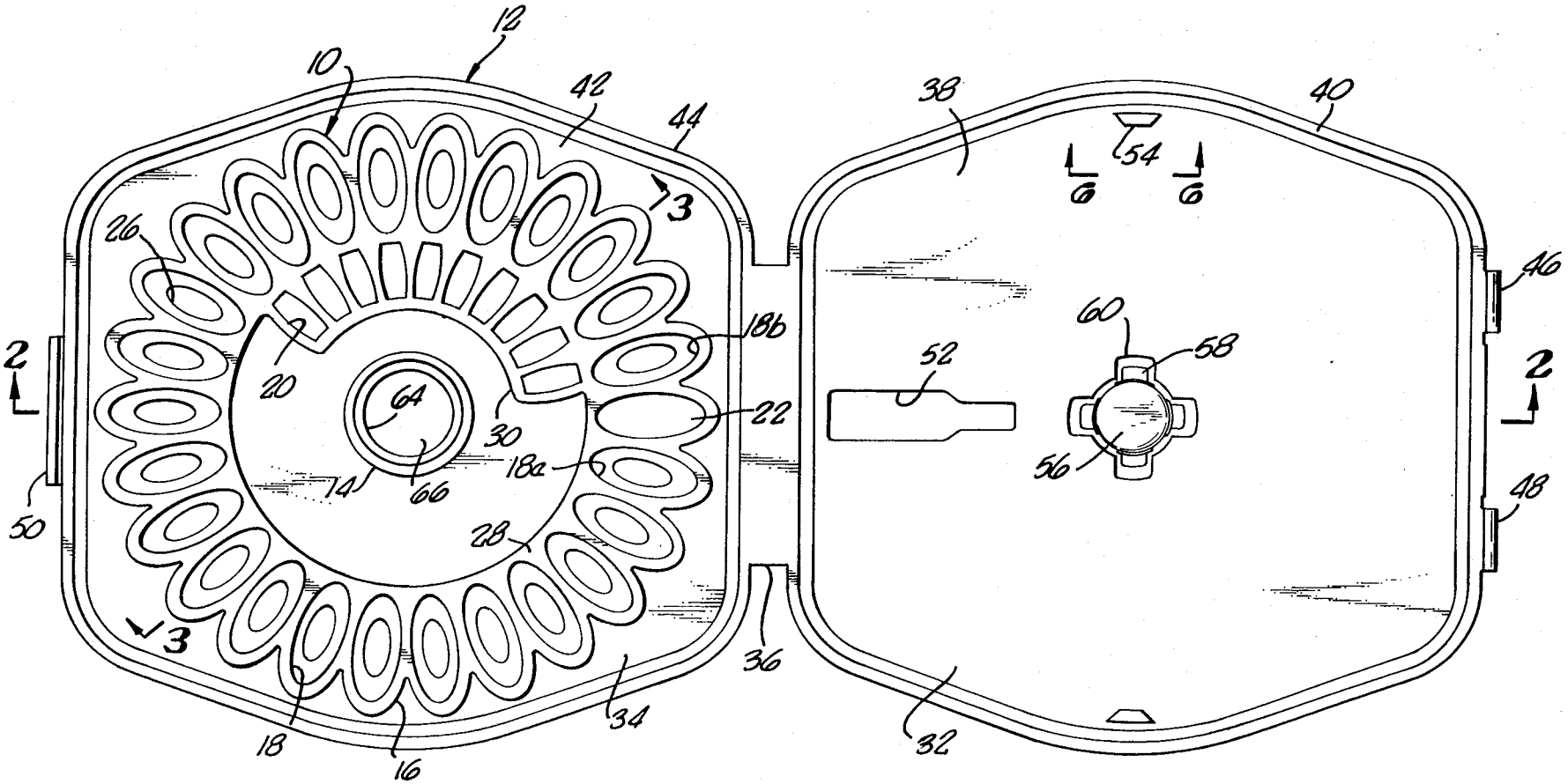
FIG. 1 is a plan view of a pill dispenser in the open condition.

Turning in detail to the drawings, a pill dispenser is illustrated as including a cartridge, generally designated 10, and a housing, generally designated 12. The cartridge 10 includes a hub 14 and a circular body 16 containing a plurality of cavities 18 and 20. Each set of cavities 18 and 20 is arranged about the hub 14 at radially equal locations from the hub 14, thus forming a circle or arc of cavities. The equal locations facilitate location and use of a dispensing hole in the housing 12 associated with the cartridge 10.

There are twenty-five larger cavities 18 positioned in a circular pattern about the hub 14 at first radially equal locations. There are ten smaller cavities 20 located at second radially equal locations from the hub 14 inwardly of the first cavities 18. The cavities 20 are each aligned with a cavity 18 in the radial direction. A distinguishable position 22 is located in line with the first radially equal locations from the hub 14 in the circular arrangement of the cavities 18 and between two of the cavities. As such, there are twenty-six positions for cavities 18 with one being the distinguishable position 22. The smaller cavities 20 are arranged such that one of these cavities 20 is aligned with one of the cavities 18 adjacent the position 22. With the dispensing of conjugated estrogens and a progesterone, cavity 18*a* is the first day's supply while cavity 18*b* is the last and 25th day's supply.

The structure of the cartridge is best illustrated in the cross-sections of FIGS. 2–5. A first side 24 of the cartridge 10 is generally planar but for the hole extending into the hub 14 and additional holes 26 associated with each of the larger cavities 18. The holes 26 allow inspection of the pills contained within the cavities 18 to insure the user of the progress of the cycle. No hole 26 is provided at the distinguishable position 22 which acts to provide a distinction over the cavities 18. The cavities are defined by an upwardly extending wall 28 extending circumferentially about the cartridge 10. A second wall portion 30, integral with the first wall portion 28, defines the smaller cavities 20. This structure exhibits relatively thin-walled construction, ideal for molded plastic materials.

Looking to the housing 12, a one-piece plastic molded constructed is illustrated as including a base 32 and a cover 34. A hinge 36 formed of relatively thin section connects the base 32 and cover 34. A suitable plastic material for longevity of the hinge 36 is advantageous.

Figures 2, 3, 4, 5, 6:
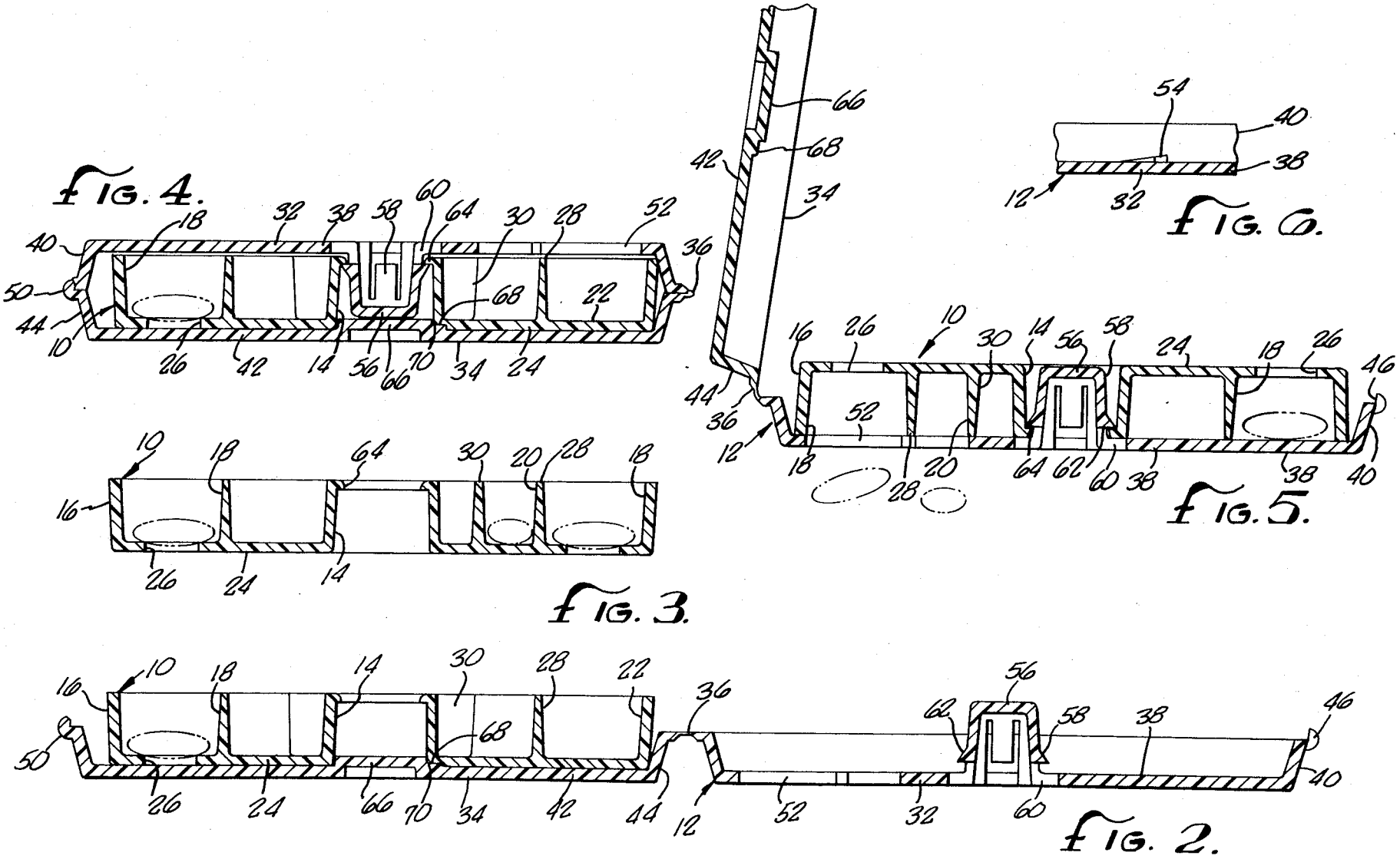
FIG. 2 is a cross-sectional elevation taken along line 2—2 of FIG. 1.
FIG. 3 is a cross-sectional elevation of the pill cartridge taken along line 3—3 of FIG. 1.
FIG. 4 is a cross-sectional elevation with the housing in the closed condition.
FIG. 5 is a cross-sectional elevation with the cover raised.
FIG. 6 is a cross-sectional elevation taken along line 6—6 of FIG. 1.

The base 34 includes a flat plate 38 and a peripheral, upstanding sidewall 40. The plan of the base may take on any appropriate and preferably aesthetic shape so as to accommodate the substantially circular cartridge. As can be seen in FIGS. 2, 4 and 5, the sidewall 40 does not extend upwardly so as to fully contain the cartridge 10 when assembled therewith.

The cover 34 includes a cover plate 42 and an upstanding sidewall 44. The sidewall 44 is much like the sidewall 40 as is the plan of the cover plate 42. When closed, the housing 12 defines a cavity which closely accommodates the cartridge. Latches 46 and 48 on the base 32 and 50 on the cover 34 engage respective portions of the sidewalls 44 and 40 of the housing to provide a secure closure in a conventional manner.

Provided through the plate 38 of the base 32 is a distribution hole 52. The hole 52 extends radially from the second radial location of the small cavity 20 to the first radial location of the larger cavities 18. In this way, communication with selected cavities depending on the angular orientation of the cartridge 10 is provided. Additionally, the hole 52 may be of any appropriate width so as to allow facile passage of the appropriate pill or pills and yet mask off adjacent cavities. With rotation of the cartridge 10, additional cavities 18 and 20 come into communication with the hole 52 for further dispensing of pills contained within those cavities.

Also associated with the plate 32 are ramps 54. The ramps 54, as best illustrated in FIG. 6, interfere with the rotation of the cartridge 10 at the outer body portion 16 so as to prevent rotation in one direction and allow easy sliding of the cartridge in a noninterlocking manner in the other direction. Consequently, the user is prevented from easily backing up the cartridge 10 relative to the dispensing hole 52.

Also associated with the base 32 is a mounting means for rotatably mounting the hub 14 of the cartridge 10. The mounting means includes a post 56. The post 56 includes interlocking members 58 conveniently at four positions. To accommodate the interlocking members 58, holes 60 surround each member 58. A ramp portion 62 of the interlocking members 58 allows easy insertion of the post 56 into the hub 14 and more difficult retraction. The hub 14 also has interlocking members in the form of an inwardly extending flange 64. The flange 64 engages and interlocks with the members 58 on the post 56 to retain the cartridge 10 in location on the base 32.

Located on the plate 42 of the cover 34 is an upstanding boss 66. The boss 66 is generally circular and extends upwardly a short distance from the surface of the plate 42 to receive the hub 14. Additionally, a protrusion is provided on the boss 66 to form a key 68. The key 68 is asymmetric to the boss. Naturally, a wide variety of asymmetries may be employed to affect the same result. Located on the hub 14 of the cartridge 10 is a keyway 70 for receipt of the key 68. Placement of the cartridge 10 in the cover 34 and angular orientation of the key 68 and keyway 70 properly orients the cartridgee 10 such that the distinguishable position 22 is located so as to be aligned with the hole 52 when the base 32 is brought into position with the cartridge 10. With the cartridge 10 thus aligned, the base 32 may be closed onto the cover 34. This results in the post 56 coming into position in the hub 14 such that the interlocking members 58 and 64 interlock. The pill dispenser is then ready for initiation of the cycle.

To properly load the pill dispenser, the cartridge 10 is positioned with the cavities 18 and 20 facing upwardly. The pills are placed in the cavities. The cartridge 10 may be then placed in the cover 34 or may have previously been placed in the cover 34 prior to the loading of the pills. The cartridge 10 is oriented such that the key 68 and keyway 70 are engaged. The base 32 is then closed with the cover 34 forcing the interlocking members 58 and 64 to become engaged. By following this process, the distinguishable position 22 is aligned with the dispensing hole 52 such that the cycle may begin. The ramp members 54 prevent inappropriate rotation of the cartridge 10 in the wrong direction such that the user may safely proceed to self-administer pills on a multiple cycle basis.

Thus, a facile loading procedure and a convenient and versatile pill dispenser are disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A pill dispenser for a prescribed dosage schedule comprising a circular cartridge having a hub, first cavities about said hub at first radially equal locations therefrom, second cavities about said hub at second radially equal locations therefrom, said first and second cavities being open to one side of said cartridge, each said second cavity being aligned with and immediately adjacent said first cavity, the numbers of each said first and second cavities being preselected for the prescribed dosage schedule, and a distinguishable position at a said first radial location;

a housing having a base and a mounting means for rotatably mounting said hub on said base with said first and second cavities of said circular cartridge opening toward said base, said base including a hole therethrough positioned adjacent said first radial location and said second radial location for selective communication with said first and second cavities.

2. The pill dispenser of claim 1 wherein there are 25 said first cavities and 10 said second cavities.

3. The pill dispenser of claim 2 wherein said first radial location is greater than said second radial location.

4. A pill dispenser for a prescribed dosage schedule comprising a circular cartridge having a hub, first cavities about said hub at first radially equal locations therefrom, second cavities about said hub at second radially equal locations therefrom, said first and second cavities being open to one side of said cartridge, and a distinguishable position at a said first radial location between two of said cavities, each of said second cavities being aligned with one of a plurality of immediately adjacent said first cavities, one of said plurality of immediately adjacent said first cavities being immediately adjacent said distinguishable position, the numbers of each said first and second cavities being preselected for the prescribed dosage schedule;

a housing having a base and a mounting means for rotatably mounting said hub on said base with said first and second cavities of said circular cartridge opening toward said base, said base including a hole therethrough adjacent said first radial distance and at said second radial distance for selective communication with said first and second cavities.

5. The pill dispenser of claim 4 wherein there are twenty-five said first cavities and ten said second cavities.

6. The pill dispenser of claim 4 further comprising means between said base and said circular cartridge for preventing relative rotation therebetween in a first direction.

7. The pill dispenser of claim 1 wherein said mounting means includes a post extending to said hub, said post and said hub having interlocking members for retaining said post and said hub in engagement.

8. A pill dispenser for a prescribed dosage schedule comprising a circular cartridge having a hub, first cavities about said hub at first radially equal locations therefrom, and second cavities about said hub at second radially equal locations therefrom, said first and second cavities being open to one side of said cartridge, each said second cavity being aligned with and immediately adjacent said first cavity, the numbers of each said first and second cavities being preselected for the prescribed dosage schedule;

a housing enclosing said cartridge and having a base, a cover and a mounting means for repeatedly mounting said hub on said base with said first and second cavities of said circular cartridge opening toward said base, said base including a hole therethrough adjacent said first radial location and adjacent said second radial location for selective communication with said first and second cavities, said cover including a boss concentrically arranged with said hub, said hub including one of a key and a keyway and said boss including the other of said key and said keyway, said key and said keyway interlocking with said cartridge in first angular alignment with said cover.

9. The pill dispenser of claim 8 wherein said circular cartridge includes a distinguishable position at said first radial location between two of said cavities, said blank space being aligned with said hole in said base with said key and keyway in engagement.

10. A method of loading a pill dispenser of the type including a cartridge having cavities thereon and a hub, and a housing for engaging the cartridge, having a cover and a base with a mounting post for mounting the hub and a hole for selected communication with the cavities of the cartridge, comprising the steps of placing pills in the cavities of the cartridge, placing the cartridge on the cover with the cavities aligned relative to the cover in a first orientation; and placing the base on the cartridge in a first alignment with the cover to engage the mounting posts of the base with the hub of the cartridge.

* * * * *